United States Patent [19]

Meloney, Jr.

[11] Patent Number: 4,879,772

[45] Date of Patent: Nov. 14, 1989

[54] DEVICE FOR CLOSING OFF A POOL SKIMMER

[76] Inventor: David M. Meloney, Jr., 857 Killarney Pass, Mundelein, Ill. 60060

[21] Appl. No.: 108,101

[22] Filed: Oct. 13, 1987

[51] Int. Cl.[4] ..... E04H 3/18

[52] U.S. Cl. ..... 4/506; 210/169

[58] Field of Search ..... 4/512, 496, 498, 499, 4/500, 506, 507, 509, 488, 489, 490, 492, 493, 494, 495, 497, 501, 502, 503, 504, 505, 508, 510, 511, 513; 210/169; 446/220, 223, 227; 441/30, 34, 66

[56] References Cited

U.S. PATENT DOCUMENTS

| | | | |
|---|---|---|---|
| 1,814,055 | 7/1931 | Napier | 446/220 |
| 2,401,252 | 5/1946 | Klimashesky | 446/220 |
| 3,176,982 | 4/1965 | O'Daniel | 446/220 |
| 3,611,623 | 10/1971 | Copstead | 446/220 |
| 3,629,878 | 12/1971 | Martin | 4/504 |
| 3,710,401 | 1/1973 | Goettl | 4/506 X |
| 4,606,083 | 8/1986 | Kingston | 4/504 |

*Primary Examiner*—A. D. Pellinen
*Assistant Examiner*—Morris Ginsburg
*Attorney, Agent, or Firm*—Neuman, Williams, Anderson & Olson

[57] ABSTRACT

A device is provided for closing off an interior portion of a pool skimmer when the pool is to be shut down for a prolonged period of time. The device includes an inflatable member of pliable, expansible, water-proof material. When the member is inflated, subsequent to being positioned within an interior portion of the skimmer, the member will close off a surface skimming inlet of the skimmer. The inflatable member is provided with a valve for controlling the inflating and deflating of the member. When the inflatable member is disposed within the skimmer interior portion, the valve is accessible through an access opening formed in the skimmer.

6 Claims, 1 Drawing Sheet

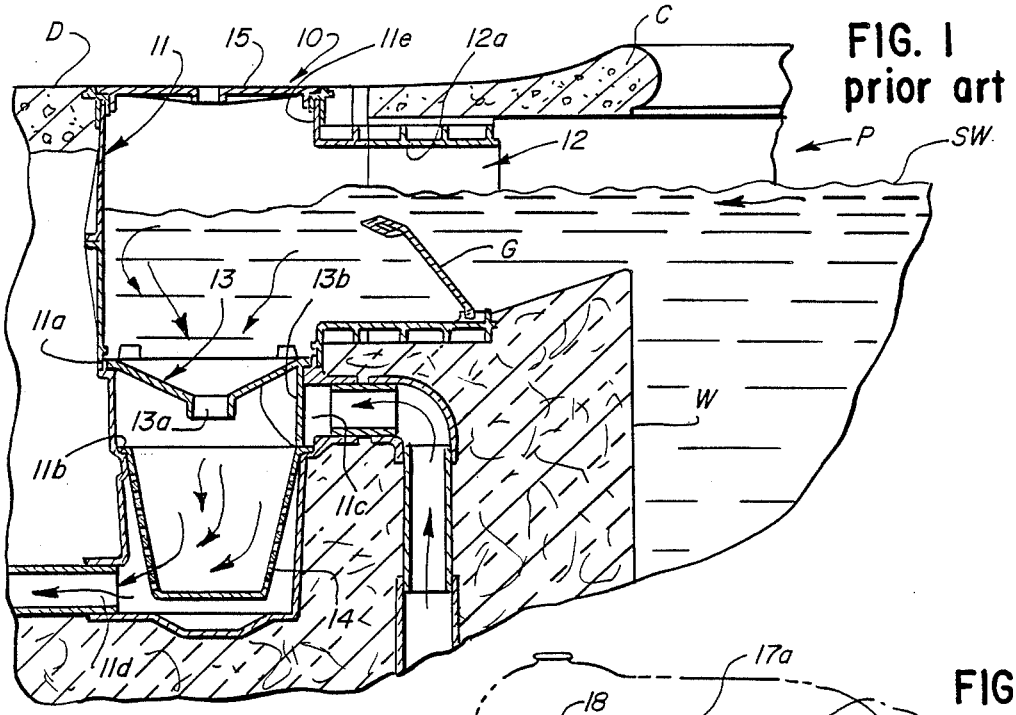
FIG. 1
prior art
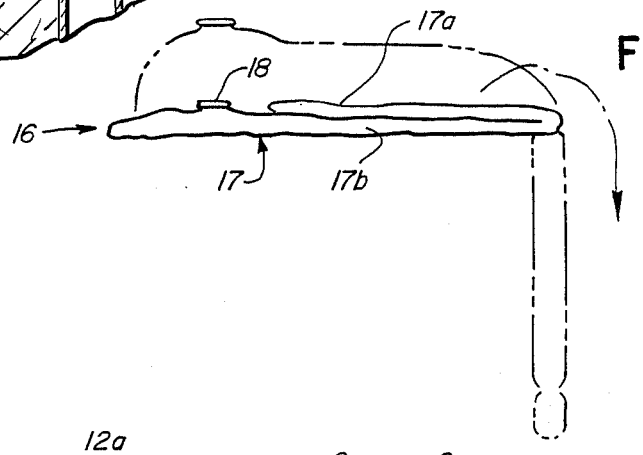
FIG. 4
FIG. 2
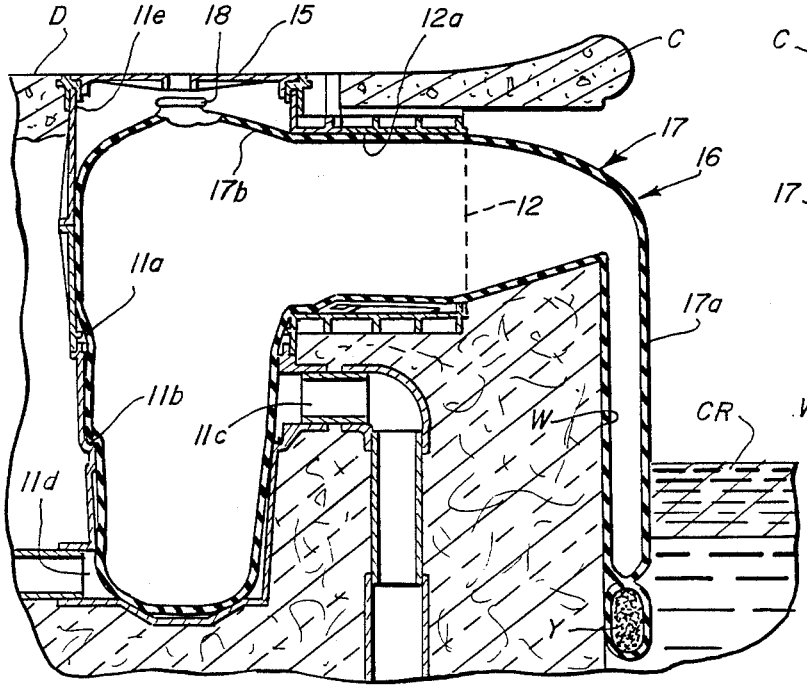
FIG. 3
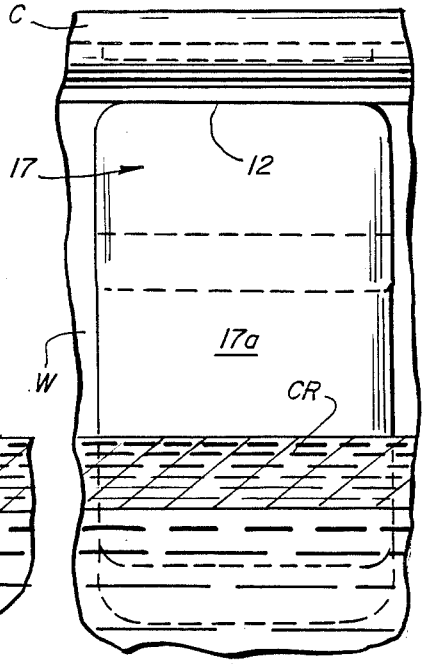

DEVICE FOR CLOSING OFF A POOL SKIMMER

BACKGROUND OF THE INVENTION

When shutting down an outdoor pool for repair or at the end of the swimming season, it is important that water, dirt and/or debris not become entrapped or lodged within the skimmers which are strategically located about the side walls of the pool. The skimmers are disposed at a predetermined elevation so that, when the pool is properly filled and the water therein is at a specified level, the surface water will circulate through a primary inlet and filter unit provided in each skimmer before being returned to the pool. Thus, under normal operating conditions, the skimmer will help to maintain the water surface free of floating leaves, bugs and other debris.

In various geographical areas where the outdoor temperatures are sub-freezing for prolonged periods of time, it is important that ceratain precautionary steps be taken, other than heating the water continuously, to prevent cracks or other damage occurring in the walls or floor of the pool or in the various components comprising the water circulation system. One of the precautionary steps is to either completely empty the pool of water or lower the level of the water so that it is substantially below the primary inlets of the skimmers. The latter procedure is the preferred one as it avoids the possibility of the empty pool heaving due to the expansion of the ground circumjacent the pool. Where a substantial amount of water remains in the pool, but the level thereof is lowered, it is important that some means be provided which will compensate for the pressures which develop against the walls when a thick ice crust forms on the water surface. If some compensating means is not provided to relieve such pressure, the walls and floor of the pool are susceptible to cracking which becomes evident when thawing occurs and thus, might require extensive and costly repairs.

Heretofore, it was thought that the placement of floating logs or the like on the water surface would provide the necessary pressure relief when the ice crust was formed. However, such a practice was, and still is, wholly ineffective because such objects either rested upon the top of the crust or became solidly embedded within the crust itself and thus, did not compensate or equalize the pressure as it developed between the wall and crust. Besides being ineffective as a pressure equalizer, the logs were a nuisance to remove from the pool and store once the thaw was completed.

When winterizing the skimmers various techniques and devices have heretofore been utilized, such as placing a bottle filled with antifreeze in a blocking position with respect to the primary inlet port of the skimmer or securing some membrane over the inlet port. Such techniques and devices were undesirable for one or more of the following reasons: (a) oftentimes the bottle was not properly sized relative to the primary inlet port, thus, requiring caulking to prevent leakage around the bottle; (b) the bottle was susceptible to breakage when improperly handled or when improperly filled with antifreeze; (c) securing a membrane over the primary inlet port was an awkward, frustrating and time-consuming operation; and (d) the membrane was susceptible to tearing or being punctured.

SUMMARY OF THE INVENTION

Thus, it is an object of the invention to provide a device of the type described which is of simple, inexpensive construction; can be readily installed in a facile manner; is effective in blocking off the skimmer primary inlet and at the same time can compensate for any pressure which might develop between the pool wall and a thick ice crust, particularly in certain geographical areas.

It is a further object to provide a device which assumes a compact size suitable for storage when it is not in use.

It is a still further object to provide a device which is of lightweight and durable construction and is capable of being utilized with a variety of skimmers, the size and shape of which vary over a wide range.

It is a still further object to provide a device which is capable of withstanding severe climatic conditions; and does not require any tools or one possessed of a high degree of dexterity in order to properly install the device within the interior of the skimmer.

It is another object to provide a device which does not require the removal or displacement of numerous components of the skimmer in order to properly position the device within the interior thereof.

Further and additional objects will become apparent from the description, accompanying drawings and appended claims.

In accordance with one embodiment of the invention, a device is provided which includes an inflatable member formed of a pliable, expansible water-proof material which is adapted, when deflated to be either folded into a compact unit suitable for storage, or be positioned within the interior of a skimmer and when subsequently inflated to close off the primary inlet port of the skimmer and block the flow of water or the passage of debris into the skimmer interior. The inflatable member is provided with an adjustable open and close valve means for controlling the inflating and deflating of the member. The valve member is accessible through an access opening formed in the skimmer.

DESCRIPTION

For a more complete understanding of the invention reference is made to the drawings wherein:

FIG. 1 is a fragmentary vertical sectional view of a conventional skimmer shown in the normal operating condition.

FIG. 2 is similar to FIG. 1 but showing one embodiment of the improved device disposed within the interior of the skimmer and in an operative mode whereby the inflatable member thereof in an inflated condition closes off communication between the primary inlet and the interior of the skimmer and a second section extends downwardly along the pool wall and terminates beneath an ice crust formed on the surface of the water.

FIG. 3 is a fragmentary front elevational view of the skimmer and improved device shown in FIG. 2.

FIG. 4 is a side elevational view of the device per se showing in full lines the inflatable member thereof in a deflated, folded condition suitable for storage and in phantom lines in an unfolded inflated condition.

Referring now to the drawings and more particularly to FIG. 1, a conventional skimmer 10 for use in an outdoor swimming pool P is shown. The skimmer 10 may be of a type disclosed in U.S. Pat. No. 3,567,020. Several circumferentially spaced skimmers are normally utilized in such a pool and each skimmer coacts with the pool filter system to effect clean, low maintenance of the pool.

Each skimmer 10 includes a hollow housing or body 11 which is disposed adjacent the upper portion of the pool side wall W. The housing 11 may be formed of either a non-corrosive metal or durable plastic material and is provided with a primary inlet 12 through which the pool surface water SW under normal operating conditions enters the interior of the housing. The primary inlet is normally provided with a weir gate G which is hingedly connected along its lower edge to the surface of a throat section 12*a* which defines the inlet 12. The gate may be biased by a foam float to normally assume an upright position. The throat section is normally located beneath a coping piece C which projects laterally inwardly from the finished deck D and substantially encompasses the upper open side of the pool. In the illustrated embodiment of the skimmer, the housing interior thereof is provided with a pair of vertically spaced shoulders 11*a* and 11*b*. Between shoulders 11*a* and 11*b*, the housing is provided with a second inlet 11*c*, which constitutes the main drain line for the pool. A pump suction outlet 11*d* is formed in the housing interior surface adjacent the lower end portion thereof and beneath the shoulder 11*b*.

Normally resting upon the upper shoulder 11*a* is a funnel shaped plate 13 having a downwardly extending tapered central opening 13*a*. The plate 13 may be manually rotated about the centerline of opening 13*a* as an axis. The underside of the plate 13 is provided with a depending semi-cylindrical flange 13*b*. When the plate assumes a predetermined position of rotational adjustment, the flange 13*b* will block off or restrict the inlet 11*c*, thus, allowing only surface water SW to flow through the skimmer interior and out by way of opening 13*a*. When inlet 11*c* is fully open, or is not completely closed off by flange 13*b*, water from the main drain line will flow through inlet 11*c* into the skimmer interior beneath the funnel shaped plate into a removable basket-type filter unit 14. Upon the surface water flowing through plate opening 13*a*, it mixes with the water flowing through inlet 11*c* and is deposited into filter unit 14 which engages and is supported by the lower shoulder 11*b* of the housing interior. Upon leaving the basket-type filter unit 14, the water flows out through the pump suction outlet 11*d*, is filtered through the filter system and heater, if there is one, and then is recirculated back to the pool.

When the swimming season is over and the pool is to be prepared for the winter season, or when the pool is to be shut down for a prolonged period of time for repair or servicing, it is important that no water, dirt, and/or debris become entrapped within the interior of the skimmer housing or within the piping comprising the circulating system. To facilitate such preparation, the water level within the pool is lowered so that it is a substantial distance (e.g. 12" or more) below the primary inlet 12. A removable cover 15, which overlies an access opening 11*e* formed in the top of the housing, is removed allowing the plate 13 and filter unit 14 to be removed through opening 11*e*. In certain situations, the filter unit 14 is cleaned and then reassembled within the housing interior, and the plate 13 is also reassembled in the housing interior. Once the plate 13 is in place, it is manually rotated so that flange 13*b* closes off inlet 11*c*. While cover 15 is removed, the tapered opening 13*a* of plate 13 is closed off by a suitable plug, not shown.

The primary inlet 12 of the housing 11 is sealed off by the improved device 16, see FIG. 2, which comprises an inflatable member 17 formed of a pliable, expansible, waterproof material. When in a deflated condition, the device is placed within the housing interior through access opening 11*e*. When placed within the housing interior, care should be exercised to be sure that the weir gate G is rotated to the fullest extent in a counterclockwise direction and a portion of the deflated member overlies same. Furthermore, a manually adjustable valve 18 carried on the inflatable member 17 should be located within the housing interior so that the valve 18 is in registration with access opening 11*e*. The member 17 is inflated manually, or by an air pump, so that member 17 will completely fill and occupy the housing interior. By reason of the member material being pliable and expansible, the inflated member 17 will substantially conform to the configuration of the housing interior. When properly inflated, member 17 will seal off inlet opening 12 from any moisture, dirt, bugs or debris.

Where the pool is an outdoor type and is located in a geographical area having sub-freezing outdoor temperatures during the winter season, it is important that any pressure exerted on the pool side wall W by the ice crust CR formed on the exposed surface of the water be equalized or relieved so as to prevent cracks or fissures being formed in the side wall and floor of the pool. Such equalizing or relief is provided by an elongated inflatable sleeve-like secondary section 17*a* which extends laterally from one side of a primary section 17*b*. Sections 17*a* and 17*b* comprise the inflatable member 17. Secondary section 17*a* is sized so that, when deflated, it will readily pass through the inlet opening 12 formed in the skimmer throat section 12*a*. The length of secondary section 17*a* should be sufficient that it will extend below the ice crust CR formed on the water surface. The distal end of section 17*a* is provided with a nonbuoyant weight Y which will cause the section 17*a* to extend downwardly from the skimmer inlet along the pool wall W. The weight Y might consist of sand, pebbles, etc. contained in a pouch formed in the distal end. The hollow interior of the secondary section 17*a* communicates with the interior of primary section 17*b* so that when member 17 is inflated via valve 18, both the primary and secondary sections will be simultaneously inflated. When the secondary section 17*a* is inflated it will form a pneumatic cushion between the ice crust CR and the adjacent portion of the pool wall W. It has been found that such pneumatic cushions at the skimmers strategically located about the pool wall equalize the pressure developed by the ice crust CR as it is being formed and thus, effectively avoid cracks or fissures forming in the pool wall and floor.

As aforementioned, member 17 is formed of a waterproof inflatable, tear-resistant material which remains pliable even in sub-freezing temperatures.

Furthermore, the material should be resistant to mildew and various chemicals, commonly utilized to prevent bacteria growth within the pool water. When the device 16 is not in use, member 17 may be readily folded so as to form a compact unit, suitable for storage, see FIG. 4.

Because of the expansion of the primary section 17*b*, when it is inflated, the interior of the skimmer housing 11 and the throat section 12*a* will be occupied by the primary section 17*b* to such an extent that no water, snow, dirt, leaves, or other debris will become entrapped therein. Furthermore, the pliable and expansive characteristics of the member material, enables the device 16 to be readily utilized with skimmers of various sizes and shapes.

In temperature geographical areas, where sub-freezing temperatures do not occur, the member 17 need not include a secondary section 17*a*. Furthermore, in skimmers wherein there is no funnel plate 13 or basket-type filter unit 14 utilized the primary section 17*b*, when being inflated, will fill the void created in the housing interior by reason of plate 13 and basket unit 14 being eliminated, see FIG. 2.

Thus, a simple, durable, inexpensive device has been provided which is highly effective in closing off a skimmer, when a pool is shut down for a prolonged period of time for repair and servicing, or when an outdoor pool is shut down after the swimming season has ended. The device is easily installed and removed from the skimmer; does not require the need for any tools by the person installing or removing the device; and does not require removal or relocating of numerous components of the skimmer when the device is in place.

I claim:

1. A device in combination with a pool having a skimmer to close off an interior portion of the skimmer when the pool is to be shut down for a prolonged period of time and the surface of the water within the pool is beneath a predetermined level; said skimmer comprising a housing mounted adjacent to but recessed from an exposed side wall surface of the pool and having an interior portion provided with a first segment communicating with the water surface when at the predetermined level and a second segment communicating with said first segment and disposed beneath said predetermined water level, a surface skimming inlet extending substantially laterally from said exposed side wall surface and communicating with the first segment whereby, when the pool water surface is at said predetermined level there is flow of surface water through said surface skimming inlet into said housing interior portion first segment through the second segment and out through a pump suction outlet port communicating with the second segment; said device comprising an inflatable member formed of a pliable, expansible waterproof material, said member, when in a deflated condition, being positioned within said skimmer housing interior portion, and when subsequently inflated substantially occupying and conforming to the configuration of the housing interior portion and effecting sealing off the inlet from the outlet port; and valve means carried on said inflatable member for controlling inflating and deflating of said member.

2. The combination of claim 1 wherein the inflatable member material remains substantially pliable when subjected to sub-freezing temperatures.

3. The combination of claim 1 wherein the inflatable member includes a primary section disposed within the skimmer housing interior portion first segment, and a secondary section disposed within the surface skimming first inlet; when said member is inflated, said primary and secondary sections being in substantially sealing engagement with skimmer housing interior surfaces defining, respectively, said interior portion first segment and said skimming first inlet.

4. The combination of claim 3 wherein the primary and secondary sections of the inflatable member are in communication with the valve means.

5. The combination of claim 4 wherein the secondary section of the inflatable member includes a weighted segment whereby a portion of said secondary section connnected to the weighted segment will remain in a downwardly extending position notwithstanding changes in the level of water within the pool.

6. The combination of claim 1 wherein the valve means is accessible through an access opening formed in the skimmer housing.

* * * * *